US009238538B2

(12) United States Patent
Sagel

(10) Patent No.: US 9,238,538 B2
(45) Date of Patent: Jan. 19, 2016

(54) EASY OPEN PACKAGE FOR SNACK BARS

(75) Inventor: Joe Sagel, Plano, TX (US)

(73) Assignee: FRITO-LAY NORTH AMERICA, INC., Plano, TX (US)

( * ) Notice: Subject to any disclaimer, the term of this patent is extended or adjusted under 35 U.S.C. 154(b) by 222 days.

(21) Appl. No.: 13/442,320

(22) Filed: Apr. 9, 2012

(65) Prior Publication Data

US 2012/0258214 A1 Oct. 11, 2012

Related U.S. Application Data

(60) Provisional application No. 61/474,109, filed on Apr. 11, 2011.

(51) Int. Cl.
*B65D 75/62* (2006.01)
*B65D 75/58* (2006.01)

(52) U.S. Cl.
CPC ..... *B65D 75/5805* (2013.01)

(58) Field of Classification Search
CPC ..... B65D 75/5888; B65D 75/5805–75/585; B65D 17/04; B65D 17/161–17/168; B65D 17/24
USPC ..... 426/122, 123, 112, 115, 394, 410; 383/200, 207–209; 229/87.05
See application file for complete search history.

(56) References Cited

U.S. PATENT DOCUMENTS 3,334,804 A * 8/1967 Watts, Jr. ..... 206/463
3,412,918 A * 11/1968 Sherman ..... B65D 75/58 222/541.6
3,615,711 A * 10/1971 Markus et al. ..... 426/110
RE27,838 E * 12/1973 Leasure et al. ..... 383/200
3,946,895 A * 3/1976 Pugh ..... 220/269
4,139,643 A * 2/1979 Hix et al. ..... 426/122
4,974,732 A * 12/1990 Sullivan ..... B65D 75/008 206/484
5,000,321 A * 3/1991 Heilmann et al. ..... 229/216
5,222,813 A * 6/1993 Kopp ..... B65D 75/5805 229/87.05
6,126,317 A * 10/2000 Anderson et al. ..... 383/207
6,352,364 B1 * 3/2002 Mobs ..... 383/200

(Continued)

FOREIGN PATENT DOCUMENTS

DE 2408816 4/1975
DE 19951357 5/2001

(Continued)

OTHER PUBLICATIONS

Translation of DE 2408816.*

(Continued)

*Primary Examiner* — Drew Becker
(74) *Attorney, Agent, or Firm* — Colin P. Cahoon; Shaukat A. Karjeker; Carstens & Cahoon, LLP

(57) ABSTRACT

A package for consumable wrapped products, such as cereal bars, power bars, granola bars or other snacks. The package may include an elongated body and a fin seal on the elongated body that folds to the left side of the package. The fin seal may be located near the center of the package or on an edge of the package and may include one or more nicks on an edge of the fin seal. The package may include a top seal and a side seal. The package may also include a tear notch for propagating a tear across the package. The package may include one or more score lines extending across the package. The package may include a vertical score that prevents further tearing of the package.

20 Claims, 2 Drawing Sheets

(56) References Cited

U.S. PATENT DOCUMENTS

| | | | | |
|---|---|---|---|---|
| 6,352,365 | B1 * | 3/2002 | Healy et al. | 383/209 |
| 6,708,826 | B1 * | 3/2004 | Ginsberg | B65D 33/001 206/425 |
| 7,481,581 | B2 * | 1/2009 | Oshima | B65D 75/5805 383/116 |
| 8,740,458 | B2 * | 6/2014 | Edwards et al. | 383/207 |
| 2004/0190800 | A1 * | 9/2004 | Peron et al. | 383/200 |
| 2005/0238265 | A1 * | 10/2005 | Schneider et al. | 383/203 |
| 2007/0274615 | A1 * | 11/2007 | Deniaud et al. | 383/207 |
| 2009/0238502 | A1 * | 9/2009 | Bhattacharjee | B65D 75/5816 383/208 |
| 2009/0285511 | A1 * | 11/2009 | Aithani | B65D 75/5805 383/200 |
| 2010/0021672 | A1 | 1/2010 | Prizzi et al. | |
| 2010/0166924 | A1 * | 7/2010 | Leathersich et al. | 426/122 |
| 2011/0064338 | A1 | 3/2011 | Surdziel | |
| 2011/0150371 | A1 * | 6/2011 | Bosman et al. | 383/200 |
| 2011/0195209 | A1 * | 8/2011 | Bosman | B23B 1/08 428/35.2 |
| 2012/0000968 | A1 * | 1/2012 | Coyne | B65D 75/5805 229/87.05 |
| 2012/0000969 | A1 * | 1/2012 | Rehkugler | B65D 75/5833 229/87.05 |
| 2014/0353336 | A1 * | 12/2014 | Zaporski | B65D 75/585 222/107 |

FOREIGN PATENT DOCUMENTS

| | | | | |
|---|---|---|---|---|
| DE | 2408816 | * | 7/2010 | B65D 75/58 |
| EP | 1057746 | | 12/2000 | |
| EP | 1391391 | | 2/2001 | |
| EP | 1464587 | | 10/2004 | |
| EP | 2204335 | | 7/2010 | |

OTHER PUBLICATIONS

Search Report and Written Opinion in related International Patent Application No. PCT/US2012/032852, dated Jul. 6, 2012.

* cited by examiner

EASY OPEN PACKAGE FOR SNACK BARS

CROSS REFERENCE TO RELATED APPLICATIONS

This application claims priority to U.S. Provisional Application Ser. No. 61/474,109, filed Apr. 11, 2011. This application is incorporated by reference in its entirety.

FIELD OF THE INVENTION

This invention relates to improved packaging for consumable wrapped products, such as cereal bars, power bars, granola bars or other snack bars.

BACKGROUND

Generally, packaging for consumable wrapped products, such as cereal bars, power bars, granola bars or other snack bars include a fin seal that folds to the right. When tearing open a package, the tear often catches on the fin seal, making it difficult to open the package to obtain access to the consumable product. Thus, a need exists for an improved packaging for consumable wrapped products.

SUMMARY OF THE INVENTION

An object of this invention described herein is to provide a package that allows for easier access to product within the package. In one aspect of the invention, the packaging includes a top edge and a bottom edge and an elongated body extending between the top edge and the bottom edge. The package may include a plurality of seals, including a top seal, a side seal, and a fin seal. The top seal may close the top edge of the package. The fin seal may fold toward the left side of the package and be positioned on a back surface of the package. In one aspect of the invention, the fin seal is located in a center portion of the package. In another aspect of the invention, the fin seal is located on an edge of the package. The fin seal may include one or more nicks on an edge of the fin seal.

The package may include a tear notch located on a side edge of the package. The tear notch may be located on the left side of the package. The tear notch may be located within the side seal portion. The package may also include one or more score lines. The score lines may assist in the tearing of the package. The plurality of score lines may extend horizontally across the package. In at least one embodiment, at least one of the score lines is positioned in the same horizontal plane as the tear notch.

In at least one aspect of the invention, the package includes a vertical score. The vertical score may be positioned on the right side of the package and prevent the package from tearing the entire width of the package. The vertical score may extend from the top edge of the package.

DETAILED DESCRIPTION OF THE INVENTION

Figure 1A:
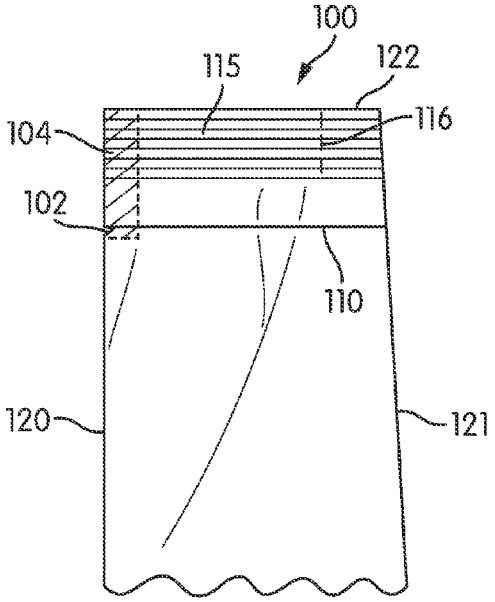
FIG. 1*a* is a front partial view of a package in accordance with at least one embodiment of the present invention.
Figure 1B:
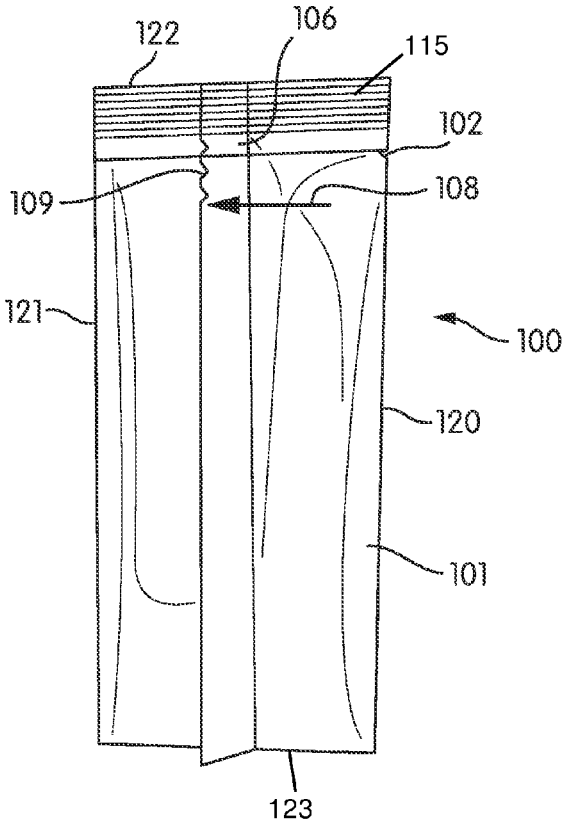
FIG. 1*b* is a back view of a package in accordance with at least one embodiment of the present invention.

In one embodiment, as illustrated in FIGS. 1*a* and 1*b*, package 100 is configured to contain one or more consumable wrapped products and may include an elongated body 101 having opposing ends 122, 123 and opposing sides 120, 121. The elongated body may extend vertically between a top 122 and a bottom 123 and horizontally between a left side 120 and a right side 121 of the package 100. The package may be made of any type of material, such as a film material suitable for containing a consumable product. The package 100 may include one or more sealing portions that keep the package 100 closed. For example, the package 100 may include a top seal 115 at the top 122 of the package 100. The top seal 115 may be created by any suitable process. For example, the top seal 115 may be created through the use of crimpers.

The package 100 may also include a side seal 104. The side seal 104 may be created through any suitable process. For example, the side seal 104 may be created through the use of crimpers. The side seal 104 may be any suitable size or shape. In at least one embodiment, the side seal 104 overlaps the top seal 115. In at least one embodiment, the side seal 104 overlaps and extends below the top seal 115.

The package 100 may include a tear notch 102 on a side of the package 100. The tear notch 102 may be on either side 120 or 121 of the package 100. The tear notch 102 may be configured to provide a consumer access to product contained within the package 100. In at least one embodiment, the tear notch 102 is located on the left side 120 of the package 100, when viewing the package 100 from the front. The tear notch 102 may be created by any suitable method. For example, the crimpers used to create side seal 104 may also create the tear notch 102. Alternatively, another type of tool or apparatus may define the tear notch 102 on the package 100.

The package 100 may also include a fin seal 106. The fin seal 106 may seal two ends of the package film material together on the elongated body 101 of the package 100. The fin seal 106 may be located on any portion of the package 100. For example, as illustrated in FIG. 1*b*, the fin seal 106 may be located in the center of the package 100. The fin seal 106 may also be located on a back surface of the elongated body 101. The fin seal 106 may be any length. In at least one embodiment, the fin seal 106 extends the length of the package 100, as indicated by direction arrow 108 in FIG. 1*b*. The fin seal 106 may be created through any suitable manufacturing process and may fold in any direction. In at least one embodiment, when the package is oriented as in FIG. 1*b*, with the top seal 115 on top, then the fin seal 106 folds to the left. To create a fin seal 106 that folds to the left, the package film may be guided to the left during the manufacturing process. It is advantageous to have the fin seal 106 fold to the left to be conducive to right-handed people to eliminate catching on the fin seal 106 when tearing open the package 100.

In at least one embodiment, the fin seal 106 includes one or more nicks 109 at the peripheral edge of the fin seal 106. The illustrated nicks 109 in FIG. 1*b* are triangular with an apex (or pointed end) pointing inboard. The illustrated triangular nicks 109 may help facilitate tearing of the fin seal 106. The nicks 109 may be created through any suitable method. For example, the nicks 109 may be created during the manufacturing process by creating a tight vertical gear portion in the fin sealing wheels to split the film. If multiple wheels are used in the manufacturing process, this can be done in either the film pull rollers or the heat seal rollers. The nicks 109 may be located at any position along the edge of the fin seal 106. For example, the nicks 109 may be located near to the horizontal plane of the tear notch. Any number of nicks 109 may be located on the fin seal 106.

In at least one embodiment, the package 100 may include at least one score line 110 that may facilitate tearing of the package 100. The score line 110 may be created by any suitable process, such as by laser scoring the film. The score line 110 may be positioned at any location on the package 100, such as near the tear notch 102. In at least one embodiment, the score line 110 is positioned in the same horizontal plane as the tear notch 102.

In the embodiment depicted in FIGS. 1*a* and 1*b*, with the fin seal 106 located at the center of package 100, when tearing the package 100, the tear initiation point starts at the tear notch 102 on the left side 120 of the package 100. The tear then propagates along the horizontal laser score 110 until hitting the fin seal 106 area. The nicks 109 formed in the fin seal 106 may help guide the tear propagation across the fin seal 106 and upon exiting the fin seal 106 area the tear propagation may rejoin with the laser score 110 on the package 100 and may tear across to the other side 121 of the package 100. In this embodiment, the entire top seal 115 may be removed more easily than known package opening techniques thus, allowing easy removal of the contents of the package 100.

Figure 2A:
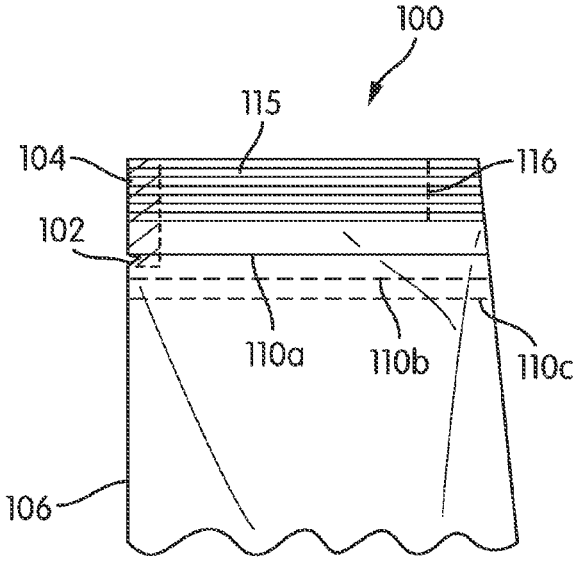
FIG. 2*a* is a partial top view of a package in accordance with at least one embodiment of the present invention.
Figure 2B:
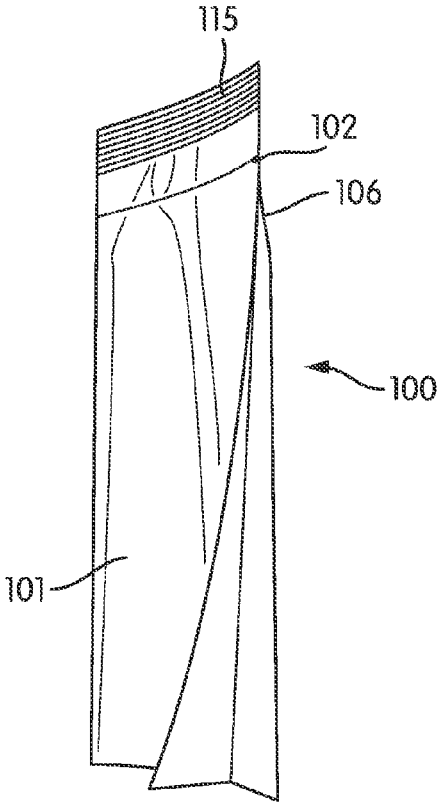
FIG. 2*b* is a back view of a package in accordance with at least one embodiment of the present invention.

In an alternative embodiment, the fin seal 106 may be located on an edge of the package 100. For example, as illustrated in FIGS. 2*a* and 2*b*, the fin seal 106 may be located on the left side 120 of the package 100 as viewed from the front of the package 100. In this embodiment, the package 100 may include a tear notch 102. The tear notch 102 may also be located on the left side 120 of the package 100. The package 100 may include at least one score line 110 that extends horizontally across the package 100 just above the formed tear notch 102.

In at least one embodiment, the package 100 may include a plurality of score lines 110. Any number of score lines 110 may be included on the package 100. In at least one embodiment, three score lines 110*a, b, c*, as depicted in FIG. 2*a*, may be created on the package 100 to allow for some float in the tear registration and ensure upon tear initiation the tear will intersect with one of the scores lines 110*a, b, c* to propagate the tear to the other side of the package 100. The three score lines 110*a, b, c* may be located anywhere on the package 100. In at least one embodiment, the three score lines 110*a, b, c* are in close proximity to the tear notch 102. For example, one of the score lines 110*a* may be positioned in the same horizontal plane as the tear notch 102 and the other two score lines 110*b, c* may be may positioned below the first score line 110.

In at least one embodiment, to keep the top seal 115 and package 100 joined together after the top seal 115 is torn away from the rest of the package 100, the package 100 may include a vertical score 116, as depicted in FIGS. 1*a* and 2*a*. The vertical score 116 may be a vertical cut on the package 100 that extends from the top 122 of the package 100. The vertical score 116 may be located anywhere on the package 100. In at least one embodiment, the vertical score 116 may be located approximately ¼ inch from the opposite side of package 100 as the tear notch 102. The vertical score 116 may extend from a top edge 122 of the package 100 and stop the linear tear propagation.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims. Additionally, one of ordinary skill in the art will appreciate that the steps illustrated in the illustrative figures may be performed in other than the recited order, and that one or more steps illustrated may be optional in accordance with aspects of the disclosure.

What is claimed is:

1. A package containing a food product comprising:
a top edge and a bottom edge;
a right side and a left side;
an elongated body extending between the top edge and the bottom edge and the right side and the left side;
a top seal on the top edge, the top seal closing at least a portion of the package;
a side seal on the left side;
a tear notch in an edge of the side seal, the tear notch configured for initiating a tear in the package at the side seal;
a score line extending horizontally across the elongated body, the score line near the tear notch such that a tear initiated at the tear notch will propagate along the score line; and
a fin seal folding toward the left side of the package when the fin seal is viewed with the package oriented with the top seal on top, the score line crossing the fin seal, and the fin seal having a peripheral edge configured with a triangular nick for guiding tear propagation along the score line across the fin; and
a vertical score extending from the top edge of the package and extending through a vertical height of the top seal, the vertical score stopping tearing of the package along the horizontal score line and allowing the top seal to remain joined to the package.

2. The package of claim 1, wherein the fin seal is positioned in a center portion of the elongated body.

3. The package of claim 2, wherein the fin seal is positioned on a back surface of the package.

4. The package of claim 1, wherein the fin seal is positioned on the left side of the package.

5. The package of claim 1, wherein the score line is positioned in a same horizontal plane as the tear notch.

6. The package of claim 1, wherein the package includes a plurality of score lines.

7. A package containing a food product comprising:
an upper edge and a lower edge;
a first side and a second side;
an elongate package body extending between the upper and lower edges and between the first and second sides;
a top seal extending along the upper edge and sealing the package contents;
a side seal on the first side;
a tear notch in the side seal to initiate a tear to open the package;
a plurality of score lines extending horizontally across the elongate body to propagate the tear initiated at the tear notch;
a fin seal spaced away from the tear notch, the plurality of score lines extending across the fin seal, the fin seal further having a peripheral edge configured with at least one triangular nick to propagate the tear, initiated at the tear notch, across the fin seal; and
a vertical score extending from the top edge and positioned on the second side of the package, the vertical score stopping tear propagation along the horizontal score line across the package and allowing the top seal to remain joined to the package.

8. The package of claim 7, wherein the plurality of score lines is three score lines.

9. The package of claim 7, wherein at least one of the plurality of score lines is in a same horizontal plane as the tear notch.

10. The package of claim 7, wherein the fin seal is positioned in a center portion of a back surface of the package.

11. The package of claim 7, wherein the fin seal is positioned at the first side of the package.

12. The package of claim 7, wherein the package is made of a film material.

13. The package of claim 7, wherein the at least one nick is in a common horizontal plane with the tear notch.

14. The package of claim 7, wherein the fin seal is folded to the left, when the fin seal is viewed with the package oriented with the top seal on top.

15. A package containing a food product comprising:

a top edge and a bottom edge;

a right side and a left side;

an elongated body extending between the top edge and the bottom edge and the right side and the left side;

a top seal on the top edge, the top seal closing at least a portion of the package;

a side seal on the left side, the side seal overlapping the top seal and extending below the top seal;

a tear notch in the side seal;

at least one score line located below the top seal and extending horizontally across the elongated body, the at least one score line located relative to the tear notch to propagate a tear initiated at the tear notch along the at least one score line;

a fin seal folding toward the left side of the package when the fin seal is viewed with the package oriented with the top seal on top, wherein the fin seal is located in a center portion of the elongated body and wherein an edge of the fin seal comprises a plurality of triangular nicks, the nicks guiding propagation of a tear through the fin seal, at least one score line extending across the fin seal; and a vertical score extending from the top edge of the package and extending through a vertical height of the top seal, the vertical score stopping tearing of the package along the horizontal score line and allowing the top seal to remain joined to the package.

16. The package of claim 15, wherein the fin seal is positioned on a back surface of the package.

17. The package of claim 15, wherein the at least one score line is positioned in a same horizontal plane as the tear notch.

18. The package of claim 15, further comprising: a vertical score extending from the top edge and positioned near the right side of the package.

19. A package containing a food product, the package comprising:

an upper edge and a lower edge;

a first side and a second side;

an elongate package body extending between the upper and lower edges and between the first and second sides;

a top seal extending along the upper edge and sealing the package contents;

a side seal on the first side, the side seal extending downward below the top seal;

a tear notch in an edge of the side seal, the tear notch configured for propagating a tear initiated at the tear notch;

a score line located entirely below the top seal and extending in a straight line laterally across the entire elongate package body, the score line near the tear notch such that a tear initiated at the tear notch will propagate along the score line;

a fin seal extending across a tear path of the score line, the fin seal having an edge configured with a triangular nick to propagate a tear initiated at the tear notch and propagating along the score line across the fin to rejoin the score line after crossing the fin; and a vertical score extending from the top edge of the package and extending through a vertical height of the top seal, the vertical score stopping tearing of the package along the horizontal score line and allowing the top seal to remain joined to the package.

20. The package of claim 19 wherein the fin seal is folded to the left, when the fin seal is viewed with the package oriented with the top seal on top.

* * * * *